United States Patent [19]

Donzis

[11] 4,441,211

[45] Apr. 10, 1984

[54] PROTECTIVE BATTING JACKET

[75] Inventor: Byron A. Donzis, Houston, Tex.

[73] Assignee: Houston Protective Equipment, Inc., Houston, Tex.

[21] Appl. No.: 512,238

[22] Filed: Jul. 11, 1983

Related U.S. Application Data

[63] Continuation-in-part of Ser. No. 478,681, Mar. 25, 1983, which is a continuation-in-part of Ser. No. 357,588, Mar. 12, 1982, abandoned.

[51] Int. Cl.[3] ..... A41D 13/00

[52] U.S. Cl. ..... 2/2; 5/434

[58] Field of Search ..... 2/2, 22; 5/434

[56] References Cited

U.S. PATENT DOCUMENTS

| | | | |
|---|---|---|---|
| 1,657,866 | 1/1928 | Mooney | 2/2 |
| 2,990,549 | 7/1961 | Doughty | 2/2 |
| 3,044,075 | 7/1962 | Rawlings | 2/22 |
| 3,162,861 | 12/1964 | Gustafson | 2/2 |
| 3,500,472 | 3/1970 | Castellani | 2/2 |
| 3,507,727 | 4/1970 | Marshack | 5/434 X |
| 3,855,631 | 12/1974 | Ettinger | 2/2 |
| 4,272,847 | 6/1981 | Buhler | 2/2 |
| 4,373,211 | 2/1983 | Goudreau et al. | 2/2 |

*Primary Examiner*—Louis Rimrodt

*Attorney, Agent, or Firm*—Arnold, White & Durkee

[57] ABSTRACT

A protective batting jacket is disclosed having a plurality of shock absorbing structures selectively positioned to be adjacent predetermined body locations of the batter to protect the batter from injury caused by a pitched ball. The shock absorbing structure includes a flexible air-tight fabric structure having an internal surface defining a chamber and an external surface adapted to be in fluid communication with the atmosphere outside the shock absorbing structure. The fabric structure includes a plurality of selectively dimensioned and disposed apertures for continuous fluid communication between the chamber and the external surface of the shock absorbing structure. A flexible foam portion having an open-celled structure defining a reservoir to releasably hold air is disposed in the cavity of the fabric structure and bonded, at least, to at least a portion of the interior surface of the fabric structure. In one embodiment, the flexible foam portion includes a multi-layered laminate of at least three open-celled foams of different foam density. The shock absorbing structure further includes shield structure to distribute the applied force across at least a portion of the fabric covered foam laminate. The plurality of shock absorbing structures includes a neck protector pad hingedly connected to the collar region of the jacket, and adapted to protect the neck of the batter.

12 Claims, 12 Drawing Figures

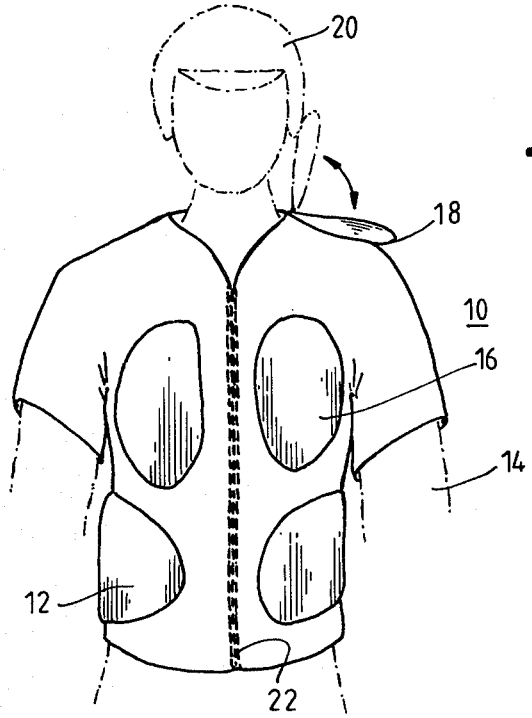
Fig. 1
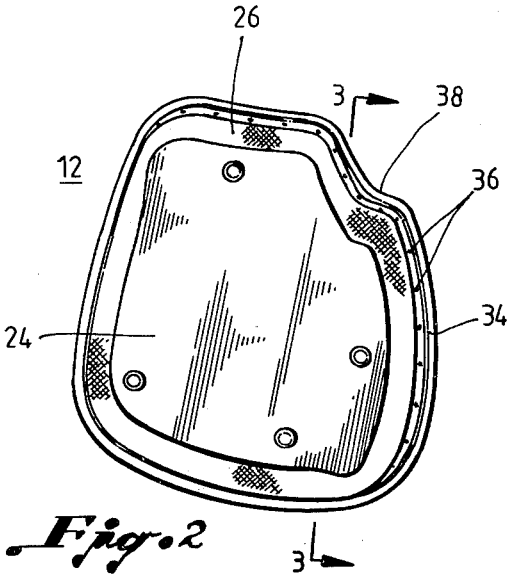
Fig. 2
Fig. 3A
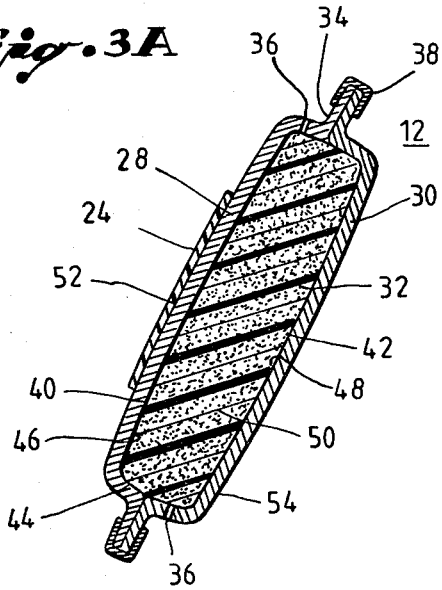
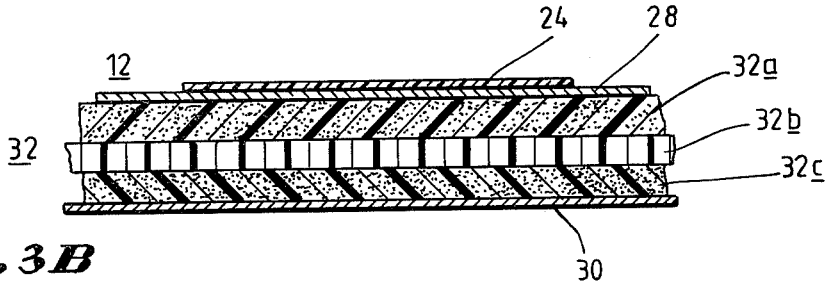
Fig. 3B

Fig. 4A
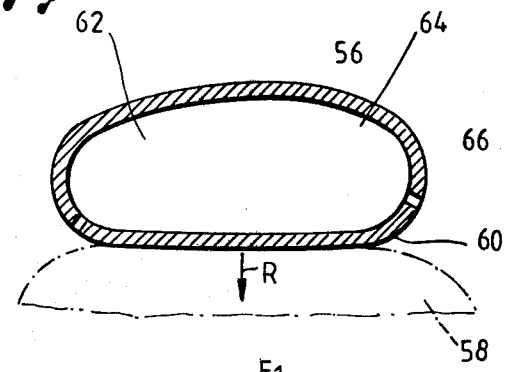
Fig. 4B
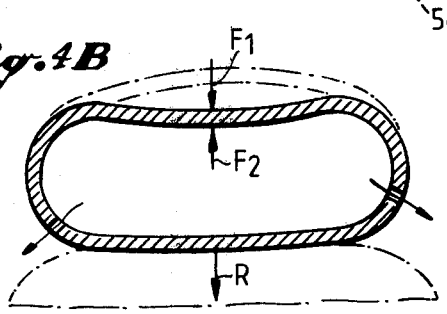
Fig. 4C
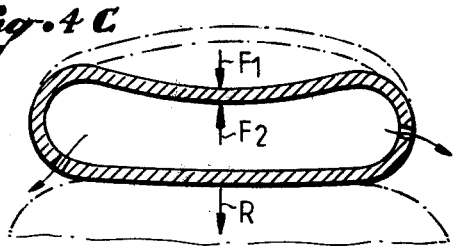
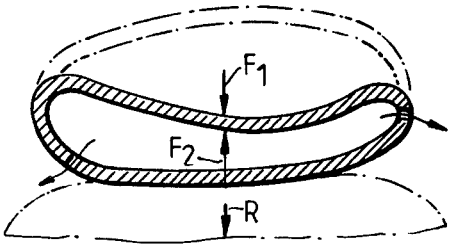
Fig. 4D
Fig. 4E
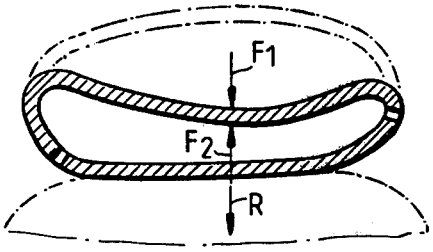
Fig. 4F
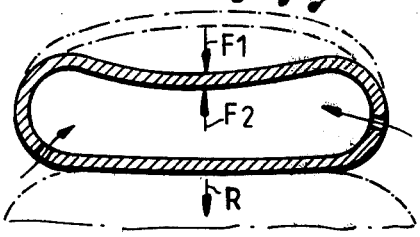
Fig. 4G
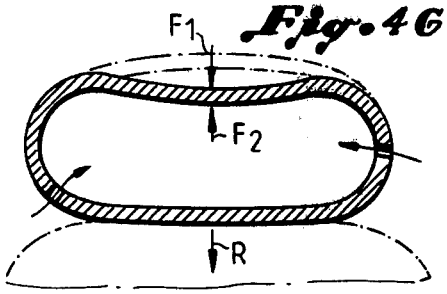
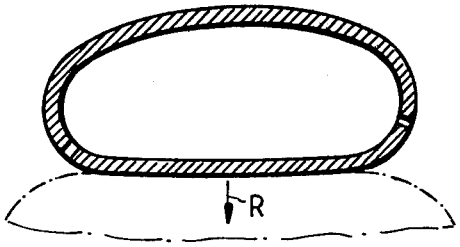
Fig. 4H

PROTECTIVE BATTING JACKET

CROSS-REFERENCE TO RELATED APPLICATIONS

This patent application is a continuation-in-part of my earlier application Ser. No. 478,681, filed on Mar. 25, 1983 for Multi-Layered, Open-Celled Foam Shock Absorbing Structure for Athletic Equipment, which in turn was a continuation-in-part of my still earlier application, Ser. No. 357,588, filed on Mar. 12, 1982 for Protective Shock Absorbing Equipment, now abandoned.

BACKGROUND OF THE INVENTION

This invention relates to protective garments, and more particularly to a protective shock absorbing jacket for wear by a person, such as a batter while up at bat during a baseball game.

Shock absorbing equipment has long been known and used where shock attenuation is required. For example, to reduce the trauma inflicted upon people in vehicle collisions, closed-cell foam materials have been used in automobile dash boards, sand-filled barrels have been deployed about highway obstructions, and air-bags that inflate upon vehicle impact have been used in passenger compartments. Raw cotton and wool batting have been used for padding and packaging needs, and both batting and inflatable members have been used in clothing and in athletic equipment.

Athletic equipment, such as shoulder pads, chest/rib protectors, thigh pads, shin guards and so forth are commonly worn by participants in a great variety of sports in which body contact with either another participant or with a piece of equipment used in the sport presents a danger of physical injury. Such equipment has long been known and used by athletes in contact sports such as football, hockey and the like.

One type of known prior art athletic equipment for use in contact sports includes a relatively hard outer shell of leather, vulcanized fiber, or similar material, and an inner layer of soft padding material. So constructed, the hard outer layer receives the applied force or shock and serves to spread the force over a large area where it is absorbed and cushioned by the soft padding material. Known prior art padding materials include cotton batting, foam rubber, foam plastic material, sponge rubber, expanded rubber and vinyl and the like, with the resilience of such materials tending to absorb a portion of the applied force.

Another known type of athletic equipment used in contact sports includes an inflatable balloon-like structure which is inflated with air to a pressure above one atmosphere and then sealed to maintain the air within the structure. When a force is imparted to such a structure, a portion of the air volume within the structure immediately adjacent the point of contact on the structure is forced to another region within the structure causing the entire structure to balloon. This ballooning effect tends to redistribute the applied force in the same manner that stepping on one end of an elongated balloon redistributes the applied force to the other end of the balloon causing that other end to bulge.

Known prior art athletic equipment for use in baseball include devices designed to be worn by the catcher to protect his chest and various other parts of his body. Such known equipment is bulky and cannot readily be worn by a batter while up at bat without limiting and hampering the batter's performance.

The known prior art equipment cannot effectively be used by a batter. Moreover, the known prior art equipment does not effectively reduce the force actually imparted to the wearer to a negligible value.

SUMMARY OF THE INVENTION

According to the present invention, a garment is provided to be worn by a person such as a batter to protect the wearer from an externally applied force occasioned by a pitched ball or the like, and injury resulting therefrom.

While the present invention has many applications, it will generally be described with reference to a batting jacket. But it will be apparent to those skilled in the art that the present teaching regarding protective garments may be advantageously applied in many other applications where controlled shock attenuation is required.

According to one embodiment of the present invention, a batting jacket includes a plurality of shock absorbing structures selectively positioned to be adjacent predetermined body locations of the batter to protect those predetermined locations from injury. The shock absorbing structure may include a neck protector pad depending from the collar region of the jacket, and positionable in a first position along the shoulder region of the jacket when the wearer's neck need not be protected, and positionable in another position approximately ninety degrees from the first and adjacent the neck of the wearer when neck protection is desired.

The plurality of shock absorbing structures may further include shock absorbing pads positioned in the jacket and shaped to protect the wearer's ribs, sternum, scapula, spine, kidneys, as well as other organs and skeletal regions.

The shock absorbing structure of the present invention utilizes a controlled transfer of air between an interior region and the atmosphere outside the shock absorbing structure to present the force inflicted upon the garment with an oppositely directed force of substantially equal magnitude to impart to the wearer a substantially negligible resultant force.

According to one aspect of the present invention, a flexible open-celled foam portion is covered with a fabric. The fabric is generally air impermeable, but has a plurality of air permeable regions selectively distributed. The air permeable regions produce continuous fluid communication between the foam portion inside the fabric covering and the atmosphere outside. Upon application of a force to the fabric covering, a portion of the volume of air contained within the cell structure of the foam is selectively transfered through the air permeable regions of the fabric covering to the outside of the fabric covering. The rate of transfer is controlled such that the inflicted force is met with a resistance of substantially equal magnitude and opposite direction to produce a resultant force of substantially negligible magnitude for infliction upon the wearer. Shield structure is included to distribute the force across the fabric covered foam.

According to another aspect of the present invention, the flexible open-celled foam portion includes a multilayered laminate of open-celled foams having different foam densities. In one embodiment of the present invention, the laminate includes at least three foam layers. In another embodiment, the laminate includes a plurality of foam layers disposed adjacent an inflatable-deflatable structural element.

According to another aspect of the present invention, the batting jacket includes a plurality of pockets each of which is adapted to removably receive a shock absorbing structure. This feature permits each wearer to custom tailor the jacket to protect only selected body locations.

According to yet another embodiment of the present invention, the shock absorbing structures are connected to the jacket using hook and loop fasteners, rivets, sewing, or in any other suitable manner.

BRIEF DESCRIPTION OF THE DRAWINGS

The invention will further be described with reference to the accompanying drawings which illustrate a protective batting jacket in accordance with the present invention, wherein like members bear like reference numerals and wherein:

FIG. 1 is a perspective view of a person wearing a batting jacket in accordance with the present invention;

FIG. 2 is a perspective view of shock absorbing structure used in the batting jacket illustrated in FIG. 1.

FIG. 3A is a section view of the shock absorbing structure illustrated in FIG. 2 taken substantially along the line 3—3;

FIG. 3B is a section view of an alternate embodiment of the shock absorbing structure illustrated in FIG. 2 taken substantially along the line 3—3; and FIGS. *4a*–*4b* are schematic illustrations of the effects of a force $F_1$ upon shock absorbing structure of the present invention.

DESCRIPTION OF THE PREFERRED EMBODIMENTS

Referring to the drawings and in particular to FIG. 1, a batting jacket 10 includes a plurality of shock absorbing structures 12. The shock absorbing structures 12 are selectively positioned in or on the batting jacket 10 so as to be adjacent predetermined body locations of a wearer 14 illustrated in fanthom lines.

The shock absorbing structures 12 may include a rib protector pad 16 positioned adjacent the wearer's ribs, as well as other pads positioned against the wearer's sternum, scapula, spine, kidneys and so forth. Such pads may be fixedly connected to the batting jacket 10 by sewing, riveting or by other suitable means, or they may be removably connected using hook and loop fastening devices, snaps, or other suitable devices. Additionally, the batting jacket 10 may include a plurality of pockets, each adapted to receive a protector pad. Removable attachment of protector pads permits the wearer to individually determine what body locations are to be protected.

The batting jacket 10 further includes a neck protector pad 18. The pad 18 depends from the collar region of the jacket 10 and is positionable in a first position adjacent the shoulder region of the jacket (illustrated by solid lines in FIG. 1) and in a second position adjacent the neck of the wearer (illustrated by fanthom lines in FIG. 1). The neck protector pad 18 is suitably dimensioned to extend across at least a portion of the wearer's neck to protect the neck from a pitched ball.

The neck protector pad 18 may be maintained in its second position against the neck of the wearer by any suitable means. For example, mating hook and loop fastening elements may be included respectively on the neck protector pad 18 and the conventional batting helmet 20 at their juncture.

The neck protector pad 18 is hingedly connected to the collar area of the batting jacket 10 such that the pad 18 is selectively movable in the direction of the arrow illustrated in FIG. 1 between the first and second neck protector pad positions. As illustrated in FIG. 1, when in its second position the neck protector pad 18 protects the left side of the wearer's neck. This is, of course, suitable for a right-handed batter. For a left-handed batter, the neck pad 18 would be positioned on the other side of the batting jacket 10. As will be apparent to those skilled in the art, a universal batting jacket may include a neck protector pad positioned on each side of the jacket so that the universal batting jacket may be used by both right-handed and left-handed batters.

The batting jacket 10 is preferably made from a nylon, fishnet fabric. It will be apparent to those skilled in the art, however, that many other suitable fabrics may be used. A zipper 22 fastens the batting jacket 10 about the wearer 14 in the embodiment illustrated in FIG. 1. It will be apparent to those skilled in the art that any suitable fastening means may be used.

The shock absorbing structure 12, including the rib protector pad 16 and the neck protector pad 18, are each similarly constructed. Removed from the batting jacket 10, the shock absorbing structure 12 is illustrated in detail in FIGS. 2 and 3.

Referring now to FIG. 2, the shock absorbing structure 12 includes a shield structure 24 disposed adjacent a fabric covered foam portion 26. The fabric covered foam portion 26 includes first and second pieces of fabric 28 and 30 disposed about a foam portion 32. The fabric pieces 28 and 30 are bonded to each other along an edge 34 to form an air-tight enclosure about the foam portion 32.

A plurality of apertures 36 are included in the fabric pieces 28 and 30 along the edge 34. The apertures 36 penetrate through the fabric causing the interior of the fabric enclosure housing the foam portion 32 to be in continuous fluid communication with the atmosphere outside the enclosure.

A binding tape 38 is placed about the edge 34 and sewn in place. Attachment of the tape 38 increases the mechanical strength of the edge 34 and enhances the appearance of the shock absorbing structure or pad 12.

One or more shield elements 24 of a semi-rigid plastic or other suitable material, such as the thermal plastic carbonate-linked polymer sold under the name LEXAN, may be affixed by suitable means to the structure 12 to distribute the inflicted force over a large surface area of the fabric covered foam portion 26. The plastic material is cut into a desired pattern and then shaped by heating or any other suitable process so that when attached to the fabric covered foam portion 26 the resulting structure or pad 12 has a desired contour adapted to engage the wearer's body.

Referring now to FIG. 3A, the foam portion 32 includes a first face 40, a second face 42, and a peripheral edge 44. The fabric pieces 28, 30 include coated faces 46, 48 defining a chamber 50, and uncoated faces 52, 54 in communication with the atmosphere outside the fabric covered foam portion 26.

The first and second faces 40 and 42 of the foam portion 32 are bonded to the coated fabric faces 46 and 48, respectively, to form a laminate which permits adjacent fabric/foam faces to move as a unit. When a nylon fabric having a polyurethane coating is used, the fabric pieces may be bonded to the foam portion by adheringly applying the fabric pieces to the foam portion, such as by heat sealing. When a nylon fabric having a polyurethane coating is not used, the fabric may be coated if desired, and then bonded to the foam portion in any suitable manner, such that the enclosure or chamber 50 formed by the fabric is substantially air-tight and the faces of the foam portion are bonded, at least in part, to the inside surface of the enclosure.

As will be apparent to those skilled in the art, any suitable method of bonding pieces of relatively air-tight fabric to the foam portion may be employed, such as the use of radio frequency induction heating techniques, the use of adhesive materials and so forth. Alternately, pieces of fabric that are not relatively air-tight may be bonded to the foam portion such that a substantially air-tight enclosure is formed.

The peripheral edge 44 of the foam portion 32 may also be bonded to the faces 46 and 48 of the fabric pieces 28 and 30. While such bonding is not necessary, it further enhances control over the transfer of air between the cellular structure of the foam portion 32 inside the enclosure and the atmosphere outside the enclosure.

The cellular structure of the foam portion 32, which is in fluid communication with the atmosphere outside the enclosure or chamber 50 by way of the apertures 36, constitutes a reservoir inside the chamber 50 which releasably holds air.

Referring now to FIG. 4, a schematically illustrated protected shock absorbing structure 56 disposed against a wearer 58 includes an air-tight fabric enclosure 60 having a chamber 62. A flexible open-cell foam portion 64 is disposed within the chamber 62 such that the outer surface of the foam portion is bonded to the inner surface of the enclosure 60.

A plurality of apertures 66 are included in the air-tight fabric enclosure 60 and provide continuous fluid communication between the chamber 62 and the atmosphere outside the protective shock absorbing structure 56.

Referring to FIG. 4*a*, in the absence of an external force inflicted upon the protective shock absorbing structure 56, the cells of the foam portion 64 in the chamber 62 contain a first volume of air at one atmosphere of pressure. The pressure within and without the protective structure 56 is the same because the apertures 66 reduce the pressure differential across the portion of the fabric enclosure 60 containing the air-permeable apertures 66 to acquiescent value of zero. Since the inflicted external force is zero, the resultant force R transmitted to the wearer 58 is also zero.

Referring now to FIG. 3*b*, a force $F_1$ is inflicted upon the protective structure 56. In the absence of the apertures 66, the inflicted force may tend to distort the shape of the chamber 62, but it cannot alter the volume of air contained within the chamber 62 because air is essentially an incompressible fluid. On the other hand, if the aperture 66 were uncontrollably large, the inflicted force $F_1$ would tend to collapse the protective structure 56 expelling the air contained within the cellular structure of the foam portion 64 through the apertures 66. In either case, a significant portion of the inflicted force would likely be imparted to the wearer. Controlled expulsion of the air contained in the cellular structure, however, reduces the resultant force imparted to the wearer to substantially zero.

As the force $F_1$ is inflicted upon the protective structure 56, a portion of the air contained in the cellular structure of the foam portion 64 is transferred from the chamber 62, through the apertures 66, and into the atmosphere outside the protective structure 56. The volume of air transferred per unit of time, which is determined by the size and number of apertures 66, is chosen to create a back pressure in the chamber 62 which presents the inflicted force $F_1$ with a force $F_2$ of equal magnitude and opposite direction. The forces $F_1$ and $F_2$ vectorially add such that the resultant force R imparted to the wearer 58 is essentially zero.

The force $F_1$ exists for some finite period of time and thus can be viewed as increasing in magnitude from zero to some maximum value, dwelling at that maximum value for some finite period of time, and then decreasing from that maximum value to zero. FIGS. 4*b*, 4*c* and 4*d* schematically illustrate the behavior of the protective structure 56 as the inflicted force increases to its maximum value.

As the magnitude of the force increases, the pressure within the chamber 62 increases to a value above one atmosphere and the air within the cellular structure of the foam portion 64 is expelled through the apertures 66. Both the air pressure in the chamber and volume of the chamber decrease.

As the force $F_1$ reaches its maximum value, the rate of change of $F_1$ per unit of time reaches zero. Therefore, the rate of change of chamber volume per unit of time and the volume of air expelled from the chamber per unit of time also reach zero. This is depicted in FIG. 4*e*.

The inflicted force $F_1$ then decreases in magnitude from the maximum value to zero, and the elasticity of the foam portion 64 causes the chamber 62 to increase in volume. As the volume increases, air is drawn through the aperture 66 and into the chamber 62 from the atmosphere outside the protective structure 56. This is schematically illustrated in FIGS. 4*f* and 4*g*. The rate at which air is drawn into the chamber 62 and thus the rate at which the volume of the chamber increases, is again determined by the number and size of the aperture 66 and is chosen such that the forces $F_1$ and $F_2$ add vectorially to produce a resultant force R of substantially zero magnitude.

After the magnitude of the inflicted force $F_1$ has decreased to zero, the chamber 62 returns to its initial volume as illustrated in FIG. 4*h*, which depicts a condition identical to that of FIG. 4*a*. In this quiescent condition, the pressure within and without the chamber 62 is at one atmosphere.

Referring once again to FIG. 3A, the foam portion 32 is an open-celled material such as polyurethane foam. It may be a reticulated foam, that is, a foam that has been fire polished to destroy the membranes or thin films joining the strands which divide contiguous cells without destroying the strands of the skeletal structure, or which has been treated chemically to destroy the strands, or any other suitable material having an open-celled structure.

The shock absorbing structure 12 is made by cutting a piece of open-celled foam to a desired pattern to produce a foam member having first and second faces and a peripheral edge. A piece of air-tight fabric is bonded to each face of the foam member, and then the two pieces of fabric are bonded to each other adjacent the peripheral edge of the foam member. A plurality of holes are then inflicted into the fabric adjacent the peripheral edge of the foam member. The holes penetrate through the fabric and through the peripheral edge of the foam member to provide continuous fluid communication between the open-celled structure of the foam and the atmosphere outside the piece of equipment. The holes are dimensioned and spaced one from the other to give the piece of equipment a predetermined responsiveness to a given inflicted force.

FIG. 3B illustrates an alternate embodiment of the foam portion 32 illustrated in FIG. 3A. Referring now to FIG. 3B, the foam portion 32 is a multi-layered laminate having foam layers 32*a*, 32*b* and 32*c*. As illustrated, the foam layer 32*a* is disposed adjacent the first piece of fabric 28, the foam layer 32*c* is disposed adjacent the second piece of fabric 30, and the foam layer 32*b* is disposed between the foam layers 32*a* and 32*c*.

Each of the foam layer 32*a*, 32*b* and 32*c* have a different foam density. The density of the foam layer 32*c*, which is designed to be disposed adjacent the body of the wearer 14, has the lowest foam density. A soft foam is used in the foam layer 32*c* to enhance comfort levels and provide proper fit. Since the shock absorbing structure 12 must be shaped to conform to the body of the wearer 14, the foam layer 32*c* must have sufficient softness to conform to the contour of the body while providing good body contact.

The outer foam layer 32*a* has a relatively high foam density. The foam 32*b* sandwiched between the high density outer foam layer 32*a* and the low density inner foam layer 32*c* has an intermediate density between the densities of the inner and outer foam layers.

The foam portion 32 illustrated in FIG. 3B has three foam densities by virtue of having three foam layers, 32*a*, 32*b* and 32*c*. More than three foam layers may be used. It is important that the foam layer closest the wearer have a low enough density for enhanced comfort and fit, and the density of the layer furthest from the wearer be sufficiently great so that the shock absorbing structure 12 adequately absorbs the inflicted force.

In alternate embodiments (not illustrated), an inflatable-deflatable structural element is used in place of either foam layer 32*a* or 32*c*. The foam portion 32 in these alternate embodiments is a multi-layered laminate of a plurality of open-celled foams having different foam densities, and the inflatable-deflatable structural element is disposed adjacent the multi-layered foam laminate. The inflatable-deflatable structural element includes an inflatable-deflatable chamber, and may include open-celled foam disposed within the chamber. The inflatable-deflatable structural element may be similar to those described in U.S. Pat. Nos. 3,675,377 and 3,866,241 which are hereby incorporated by reference.

Referring again to FIG. 3B, the shock absorbing structure 12 is made by bonding together a plurality of open-celled foam layers having different foam densities to form a laminate, and cutting the laminate to a desired pattern. Alternatively, a plurality of foam layers may each be cut to a desired pattern, and then the cut members bonded together to form a laminate. In either case, the laminate foam member has first and second faces and a peripheral edge. A piece of air-tight fabric is bonded to each face of the foam member, and then the two pieces of fabric are bonded to each other adjacent the peripheral edge of the foam member. A plurality of holes are then inflicted into the fabric adjacent the peripheral edge of the foam member. The holes penetrate through the fabric and through the peripheral edge of the foam member to provide continuous fluid communication between the open-celled structure of the foam and the atmosphere outside the shock absorbing structure 12. The holes are dimensioned one from the other to give the shock absorbing structure 12 a predetermined responsiveness to a given force.

The air permeable regions selectively distributed in the generally air impermeable fabric for controlled continuous fluid communication between the foam portion enclosed by the fabric and the atmosphere outside need not be apertures. Any suitable structure may be used which provides such controlled continuous fluid communication. For example, one or more discrete valve members may be used. Valve members which permit fluid flow in only one direction may also be used, provide the unidirectional valve members are disposed such that at least one permits air to flow into the enclosure and at least one permits air to flow out of the enclosure.

The shield structure 24 need not be made of semi-rigid plastic. Any suitable structure which distributes the inflicted force over a relatively large surface area may be used. Additionally, the shield structure may be included within the fabric enclosed foam laminate.

The principals, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A garment adapted to be worn by a person such as a batter to protect said person from infliction of an externally applied force occasioned by a pitched ball or the like, said garment comprising:

jacket structure adapted to be worn by said person, said jacket structure including:

a collar region adapted to be disposed proximate the collar bone of said person;

a shoulder region adapted to be disposed adjacent a shoulder of said person; and at least one shock absorbing structure selectively positioned to be adjacent at least one predetermined body location of said person, said at least one shock absorbing structure including:

a neck protector pad depending from said jacket structure proximate said collar region, said neck protector pad being selectively positionable in a first position proximate the shoulder region of said jacket structure, and in a second position angled approximately ninety degrees from said first position wherein said neck protector pad is adapted to protect the neck of said person;

wherein at least one of said shock absorbing structures comprises:

a flexible enclosure having first and second faces and a periphery defining a chamber, said first and second faces being air impermeable and said periphery having at least one air impermeable region and at least one air permeable region such that said chamber is in continuous fluid communication with the atmosphere outside the shock absorbing structure;

a flexible open-celled foam portion having first and second faces disposed adjacent to and bonded at least in part to said first and second faces, respectively, of the flexible enclosure, and having a periphery disposed adjacent said periphery of the flexible enclosure, the cells of said foam portion releasably holding a volume of air selectively varied between first and second volumes differing by a volume differential in response to application and removal of the force on the shock absorbing structure, said volume differential being transferred between the foam portion and the atmosphere outside the shock absorbing structure through said at least one air permeable region of the periphery of the flexible enclosure; and shield structure disposed adjacent one of said first and second faces of the foam portion to distribute the applied force across at least a portion of said one face.

2. The garment according to claim 1:

wherein said flexible enclosure comprises a nylon fabric having a polyurethane coating on one face, said flexible open-celled foam portion comprises polyurethane foam, and the coated face of the fabric is heat sealed at least in part to the polyurethane foam portion; and further wherein said flexible open-celled foam portion comprises a multi-layered laminate having:

an inner foam layer having a first foam density;

an outer foam layer having a second foam density; and an intermediate foam layer having a foam density intermediate said first and second foam densities.

3. The garment according to claim 1 wherein at least one of said shock absorbing structures includes an inflatable-deflatable structural element disposed adjacent the flexible open-celled foam portion.

4. The garment according to claim 3 wherein said inflatable-deflatable structural element includes an open-celled foam member.

5. The garment according to claim 3 wherein said inflatable-deflatable structural element is disposed adjacent said shield structure.

6. The garment according to claim 1 wherein said open-celled foam portion comprises a multi-layered laminate having a plurality of foam layers of different foam density.

7. The garment according to claim 1 wherein said at least one shock absorbing structure further includes a rib protector pad.

8. The garment according to claim 1 wherein said at least one shock absorbing structure further includes a sternum protector pad.

9. The garment according to claim 1 wherein said at least one shock absorbing structure further includes a scapula protector pad.

10. The garment according to claim 1 wherein said at least one shock absorbing structure further includes a spine protector pad.

11. The garment according to claim 1 wherein said at least one shock absorbing structure further includes a kidney protector pad.

12. A garment adapted to be worn by a person such as a batter to protect said person from infliction of an externally applied force occasioned by a pitched ball or the like, said garment comprising:

jacket structure adapted to be worn by said person, said jacket structure including:

a collar region adapted to be disposed proximate the collar bone of said person;

a shoulder region adapted to be disposed adjacent a shoulder of said person; and a plurality of shock absorbing structures selectively positioned to be adjacent predetermined body locations of said person, said plurality of shock absorbing structures including:

a neck protector pad depending from said jacket structure proximate said collar region, said neck protector pad being selectively positionable in a first position proximate the shoulder region of said jacket structure, and in a second position angled approximately 90° from said first position wherein said neck protector pad is adapted to protect the neck of said person;

wherein at least one of said shock absorbing structures comprises:

a flexible enclosure having first and second faces and a periphery defining a chamber, said first and second faces being air impermeable and said periphery having at least one air impermeable region and at least one air permeable region such that said chamber is in continuous fluid communication with the atmosphere outside the shock absorbing structure;

a flexible open-celled foam portion comprising a multi-layered laminate of at least three open-celled foam layers of different foam density, said foam portion having first and second faces disposed adjacent to and bonded at least in part to said first and second faces, respectively, of the flexible enclosure, and having a periphery disposed adjacent said periphery of the flexible enclosure, the cells of said foam portion releasably holding a volume of air selectively varied between first and second volumes differing by a volume differential in response to application and removal of the force on the shock absorbing structure, said volume differential being transferred between the foam portion and the atmosphere outside the shock absorbing structure through said at least one air permeable region of the periphery of the flexible enclosure; and shield structure disposed adjacent the face of the multi-layered laminate having the highest foam density to distribute the applied force across at least a portion of said face; and wherein said flexible enclosure comprises a nylon fabric having a polyurethane coating on one face, said flexible open-celled foam portion comprises polyurethane foam, and the coated face of the fabric is heat sealed at least in part to the polyurethane foam portion; and further wherein said at least three open-celled foam layers of the flexible open-celled foam portion comprises:

an inner foam layer having a first foam density;

an outer foam layer having a second foam density; and an intermediate foam layer having a foam density intermediate said first and second foam densities.

* * * * *

UNITED STATES PATENT OFFICE

CERTIFICATE OF CORRECTION

Patent No. 4,441,211 Dated April 10, 1984

Inventor(s) Byron A. Donzis

It is certified that error appears in the above-identified patent and that said Letters Patent are hereby corrected as shown below:

Column 3, line 31, should read as follows:

Figs. 4a-4h are schematic illustrations of the effects

Signed and Sealed this

Fourth Day of September 1984

[SEAL]

Attest:

GERALD J. MOSSINGHOFF

Attesting Officer

Commissioner of Patents and Trademarks